US007156683B2

(12) United States Patent
Gupta et al.

(10) Patent No.: US 7,156,683 B2
(45) Date of Patent: Jan. 2, 2007

(54) SYSTEM AND METHOD FOR PUSH-PUSH CABLE CONNECTION

(75) Inventors: Rinku Gupta, Austin, TX (US); Ronald Pepper, Round Rock, TX (US)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 10/968,582

(22) Filed: Oct. 19, 2004

(65) Prior Publication Data

US 2006/0084313 A1 Apr. 20, 2006

(51) Int. Cl.
*H01R 13/627* (2006.01)

(52) U.S. Cl. ..... 439/352; 439/372

(58) Field of Classification Search ..... 439/345, 439/352, 357, 372

See application file for complete search history.

(56) References Cited

U.S. PATENT DOCUMENTS 2,944,241 A * 7/1960 Londell, Jr. ..... 439/357
5,336,099 A * 8/1994 Aldous et al. ..... 439/131
5,637,018 A * 6/1997 Gargiulo ..... 439/640
6,022,235 A * 2/2000 Zhang ..... 439/332
6,250,694 B1 6/2001 Weiland ..... 292/110
6,438,229 B1 * 8/2002 Overy et al. ..... 379/446
6,666,484 B1 * 12/2003 Branch et al. ..... 292/128
6,863,554 B1 * 3/2005 Glad ..... 439/344

* cited by examiner

*Primary Examiner*—Thanh-Tam Le
(74) *Attorney, Agent, or Firm*—Hamilton & Terrile, LLP; Robert W. Holland

(57) ABSTRACT

A networking cable connects and disconnects with an information handling system port through activation of a push-push latch. A first push of the cable's connector, such as a RJ-45 connector, into a port engages the push-push latch to secure the cable in the port. A second push of the cable's connector into the port releases the push-push latch to allow removal of the cable from the port. A cable connector having a clip avoids engagement of the clip with the port by openings of the port and latch that are aligned with the clip. A biasing mechanism provides a biasing force against the cable connector to aid in removal of the cable from the port.

20 Claims, 6 Drawing Sheets

SYSTEM AND METHOD FOR PUSH-PUSH CABLE CONNECTION

BACKGROUND OF THE INVENTION

1. Field of the Invention

The present invention relates in general to the field of information handling system cable connections, and more particularly to a system and method for push-push connection of clipped cables to an information handling system.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems often interact with a number of peripherals to communicate, print or otherwise process information. For instance, server information handling systems typically communicate with client information handling systems using Ethernet communicated over Cat 5 cables. A typical network cluster has one or more of server information handling systems, switches and routers interconnected with each other and with client information handling systems by a plurality of Cat 5 cables. Generally, network clusters are installed in a restricted space so that information handling system manufacturers design and build hardware having as small of a footprint as possible. For instance, industry standards define the proportions allowed for "1U" server information handling systems to include limited height. Generally the Cat 5 cables connect to the exposed front of the server information handling system to reduce the amount of maneuvering that information technology administrators face when connecting or disconnecting cables. Cat 5 cables typically terminate with a standardized RJ45 connector that attaches to a port with an elastic clip. When the RJ45 connector is pushed into a port, the clip is depressed by the insertion force and, after complete insertion, is released to engage the port, thus locking the connector in place. To release an RJ45 connector, the clip is manually depressed and the connector is pulled from the port.

Although clipped cable connectors, such as the RJ45 connector, are ubiquitous in the information technology and telecommunications industries, a number of problems often arise with their use. One difficulty is that the clips tend to be difficult to manipulate when removing the connectors from ports in low form-factor high-density systems, such as server information handling systems. For instance, an information technology administrator often has difficulty grasping a clip when multiple connectors are presented in a limited space. When a large number of cables are being disconnected, the repeated manipulation of the clips is tiresome and time consuming. Failure to adequately depress a clip while attempting to extract a cable from a port may cause damage to the cable, the connector or the port. Another difficulty is that the clips extend out from the connector and sometimes snag on objects, making the routing of cables more difficult when trying to pull the cable through cable trays or by other cables. If a clip breaks, the connector becomes essentially useless since the cable will not secure in a port. Replacement of cables and connectors due to a broken clip delays installation and maintenance, in some instances knocking an entire network cluster out of operation for extended periods.

SUMMARY OF THE INVENTION

Therefore a need has arisen for a system and method which securely connects a networking cable to an information handling system without a connector clip.

In accordance with the present invention, a system and method are provided which substantially reduce the disadvantages and problems associated with previous methods and systems for connecting networking cables to information handling systems. A networking cable secures to an information handling system port with a first push of the cable connector into the port, and is released from the port with a second push of the cable connector into the port. Cable connector clips align with an opening of the port to avoid clip coupling, thus allowing release of clipped connectors without manipulation of the clip.

More specifically, a latching mechanism disposed in the port biases to an open position sized to accept a cable connector, such as an RJ-45 connector terminating a Cat 5 cable. Resilient opposing sidewalls couple to a rear wall and move proximate to a leveraging mechanism. Pushing of the cable connector against the rear walls overcomes a biasing mechanism to move the rear wall and the sidewalls relative to the leveraging mechanism. The leveraging mechanism leverages the sidewalls towards each other so that a latching surface extending from one or more of the sidewalls into the port engages the cable connector. A push-push lock coupled to the latching mechanism engages on a first push so that the latching surface remains engaged with the connector. The push-push lock disengages on a second push to release the latching mechanism so that the biasing mechanism bias the latching mechanism and connector out of the port, thus disengaging the latching surface from the connector to allow removal of the connector from the port.

The present invention provides a number of important technical advantages. One example of an important technical advantage is that network cables connect and disconnect from an information handling system without the use of a cable clip. Secure cable connections are provided whether or not a cable connector has a clip so that a broken clip will not disable a cable. Quick cable release with a pushing motion instead of a clip actuation reduces the manual manipulation associated with cable disconnection. Thus, information technology staff are able to more easily remove cables in a restricted space for more rapid installation and maintenance of information handling systems.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Coupling networking cables to an information handling system with a push-push latch reduces the time and space used during removal of the cables from the information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
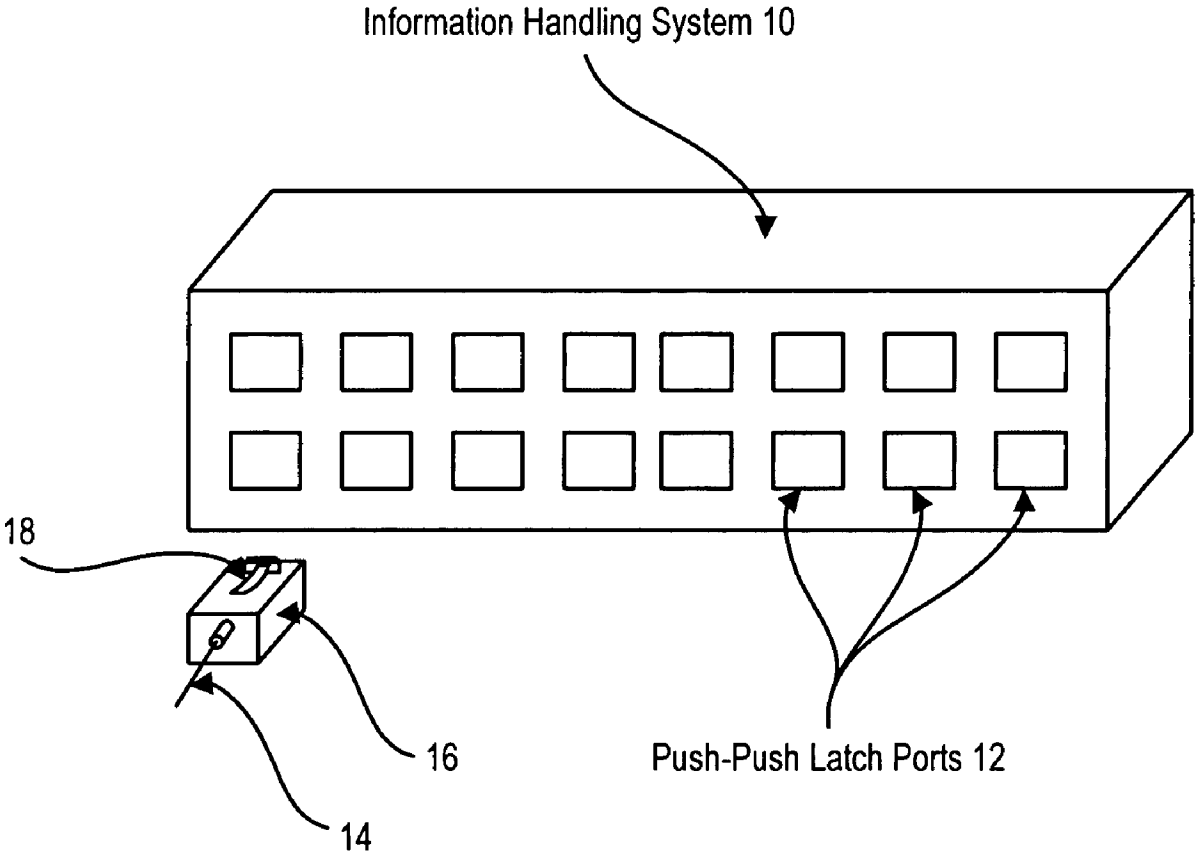
FIG. 1 depicts a server information handling system having plural networking ports that couple to networking cables with push-push latches.

Referring now to FIG. 1, a server information handling system 10 is depicted with plural push-push latch ports 12. Server information handling system 10 includes plural processing components, such as CPUs and storage devices, that process information for communication over a network through push-push latch ports 12. For instance, plural Cat 5 Ethernet cables 14 terminate with RJ-45 connectors 16 that electrically interface the cables with the processing components through the ports 12. Cable connectors 16 may or may not have a clip 18 positioned to secure connector 16 to a port 12. Push-push latch ports 12 engage connectors 16 on an initial push of a connector 16 into a port 12 without engagement of clip 18. A connector 16 releases from a port 12 by a subsequent push of the connector into the port. Securing of a connector 16 to a port 12 does not require a clip 18 since existing clips are not engaged with the port, and release of a connector 16 from a port 12 does not require manipulation of the unengaged clip 18.

Figure 2:
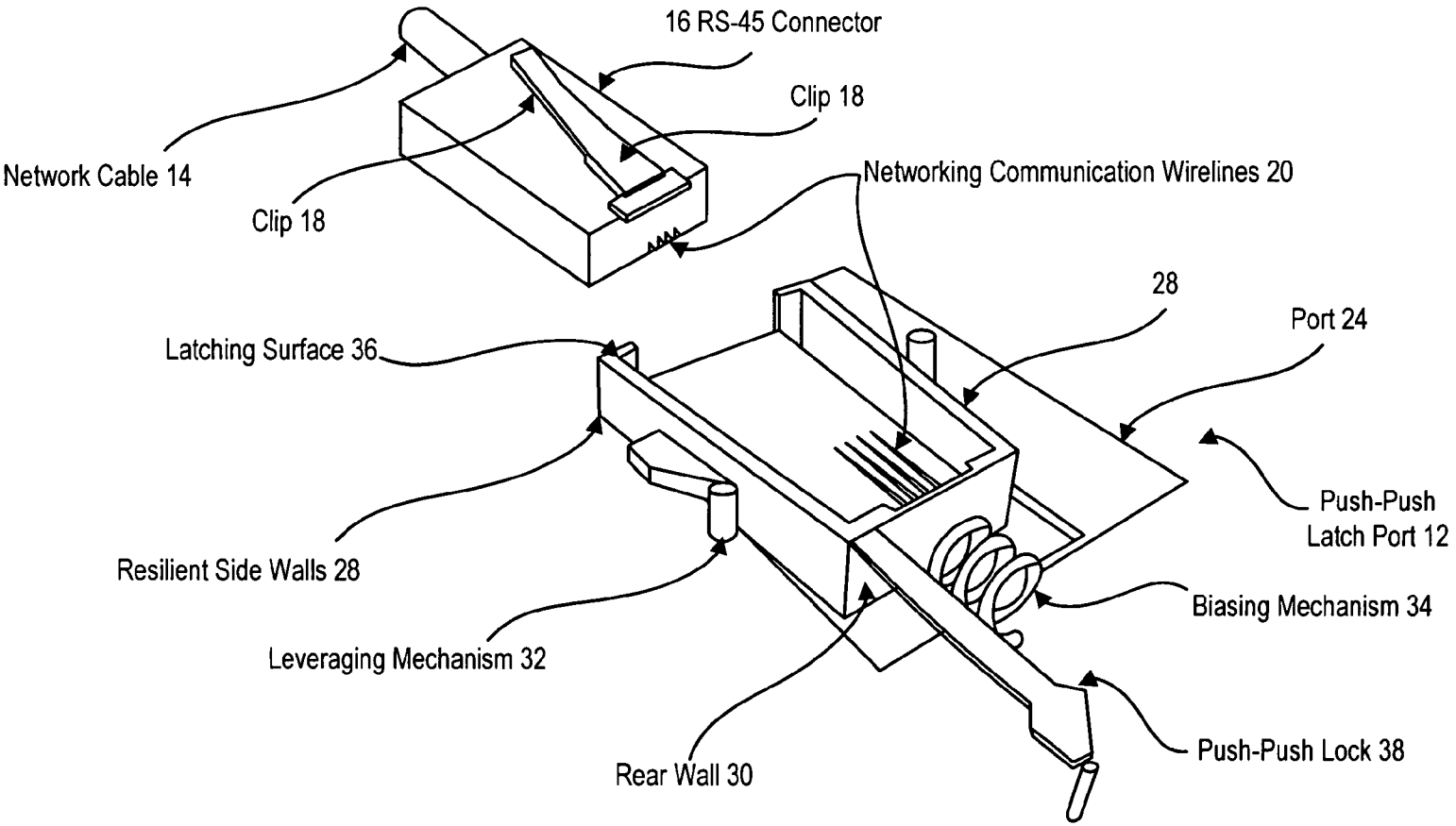
FIG. 2 depicts a rear perspective view of a push-push latch prepared to accept a networking cable.
Figure 3:
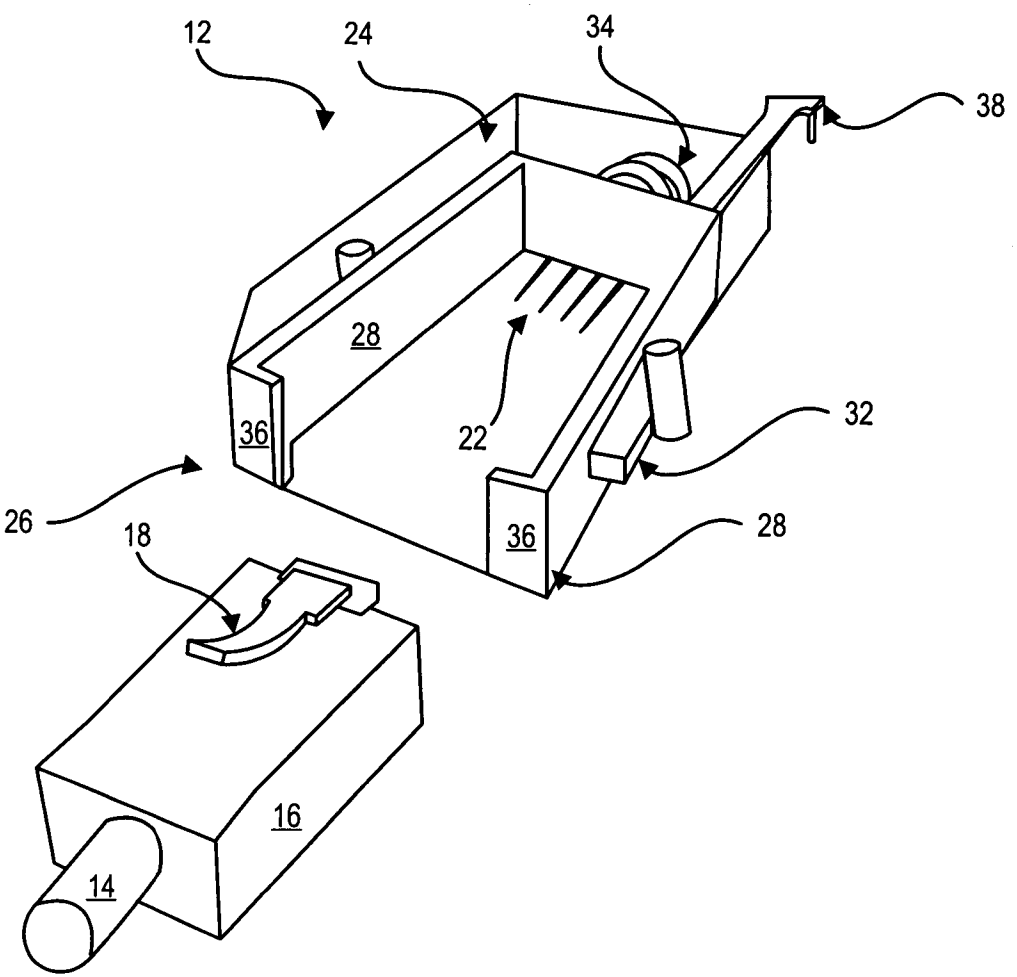
FIG. 3 depicts a front perspective view of a push-push latch prepared to accept a networking cable.

Referring now to FIGS. 2 and 3, front and rear perspective views of one embodiment of a push-push latch port 12 are depicted. Networking cable 14 terminates with a RJ-45 connector 16 having a clip 18. Networking wirelines 20 of cable 14 interface through connector 16 with wirelines 22 of information handling system port 24. A latching mechanism 26 disposed in port 24 moves along the insertion axis of connector 16 in cooperation with connector 16 as connector 16 is inserted into and removed from port 24. Latching mechanism 26 has opposing resilient sidewalls 28 coupled to a rear wall 30 with sidewalls 28 biased to move away from each other. Resilient sidewalls 28 press against a leveraging mechanism 32 that determines the distance between sidewalls 28. A biasing mechanism 34 presses against rear wall 30 to bias latching mechanism 26 outward from port 24. The distance between resilient sidewalls 28 that is established by leveraging mechanism 32 with a full outward bias by biasing mechanism 34 is such that connector 16 may be inserted past latching surfaces 36 to press against rear wall 30.

As a connector 16 presses against rear wall 30 of latching mechanism 26, the force of the push of connector 16 translates through rear wall 30 to pull resilient sidewalls 28 towards the rear of port 24. As resilient sidewalls 28 move in conjunction with rear wall 30 towards the back of port 24, leveraging mechanism 32 pushes resilient sidewalls 28 toward each other so that latching surface 36 engages connector 16 to secure connector 16 within port 24. A push-push lock 38 automatically locks latching mechanism in position at the back of port 24 so that latching surface 36 secures connector 16 in port 24 after a first push of connector 16 into port 24. A subsequent push against connector 16 into rear wall 30 releases push-push lock 38 so that biasing mechanism 34 pushes latching mechanism 26 forward in port 24. As latching mechanism 26 moves forward, leveraging mechanism 32 increases the distance between resilient sidewalls 28 to release connector 16 from latching surfaces 36.

Figure 4:
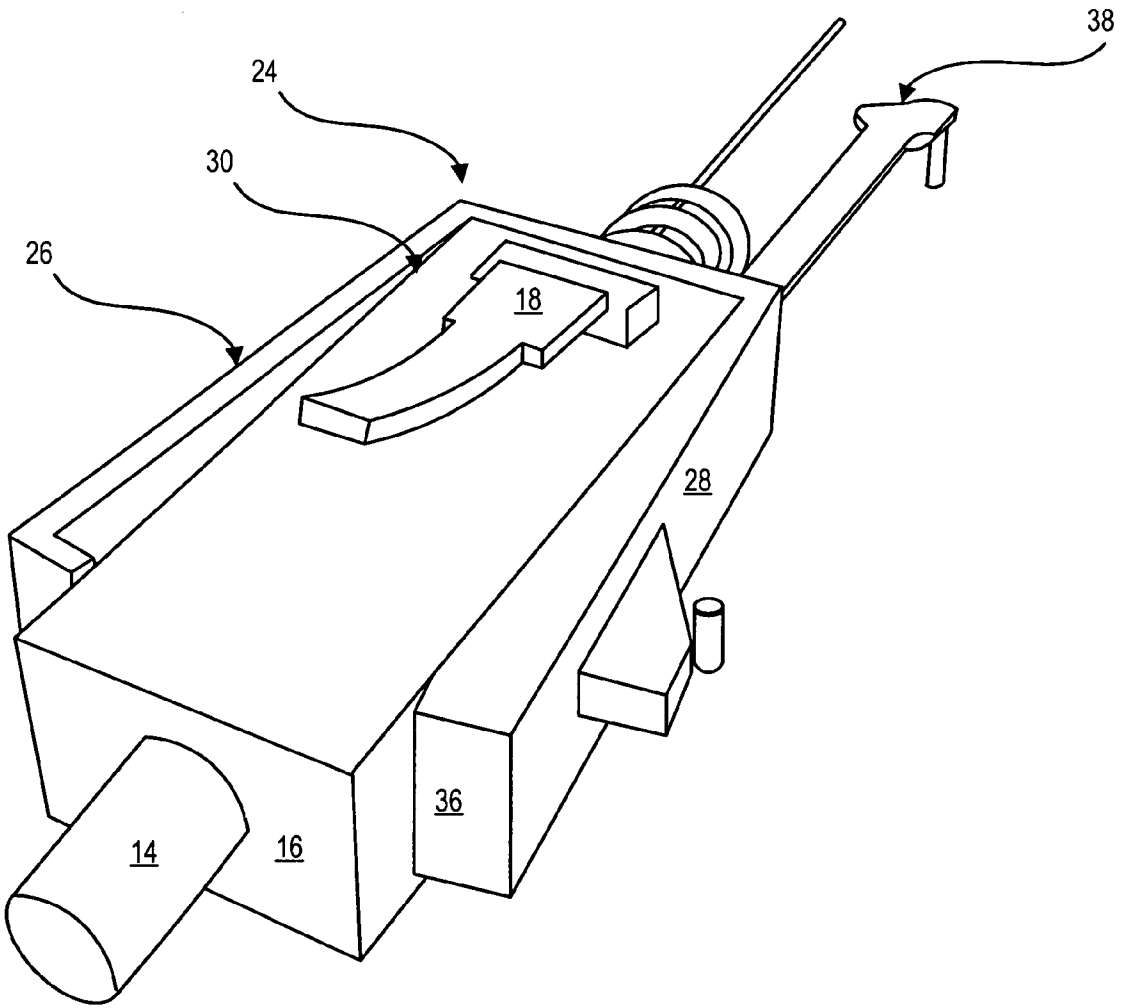
FIG. 4 depicts a front perspective view of a push-push latch securing a networking cable in an information handling system port.
Figure 5:
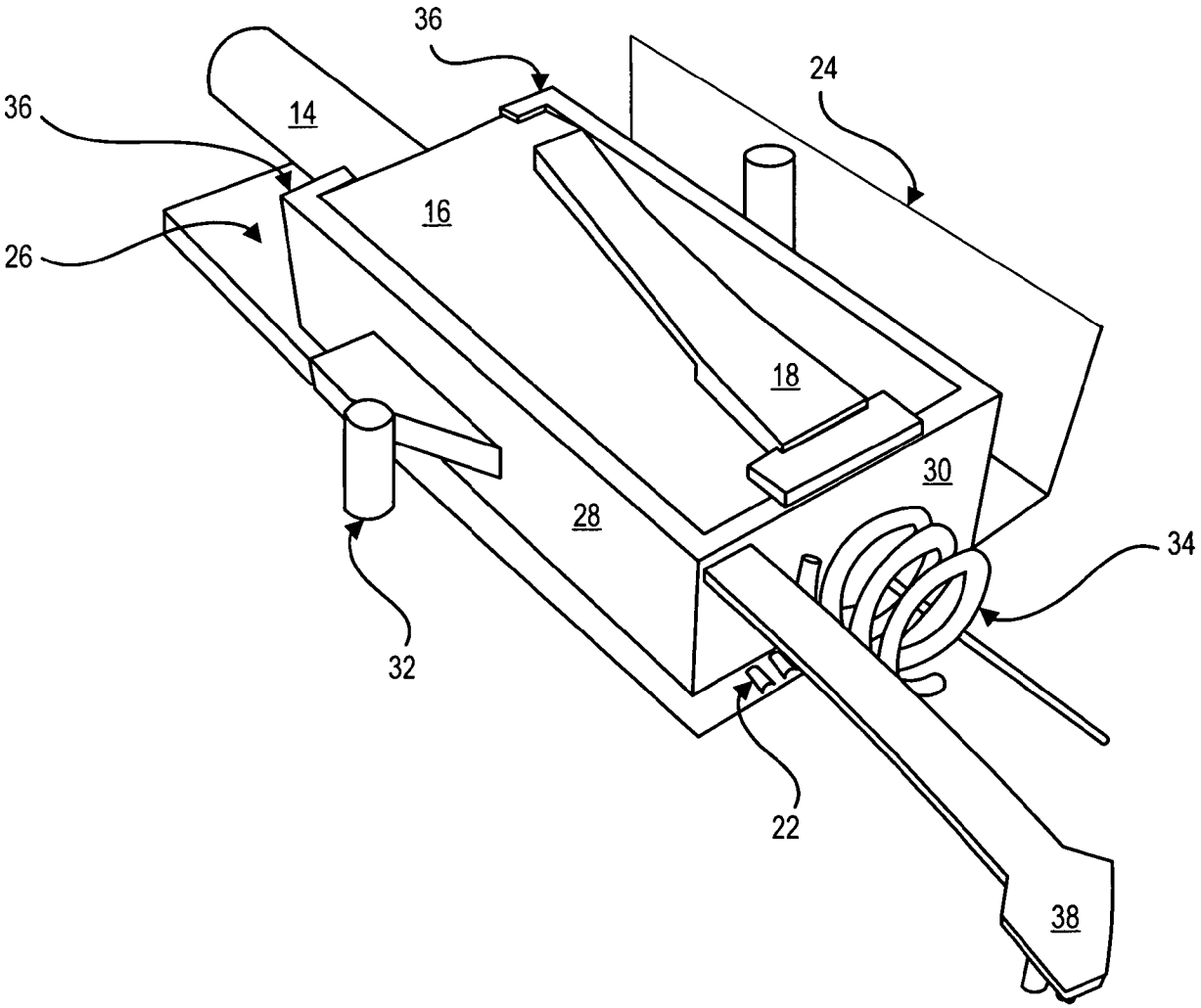
FIG. 5 depicts a rear perspective view of a networking cable secured by a push-push latch in an information handling system port.

Referring now to FIG. 4, a front perspective view depicts a connector 16 partially inserted in a port 24 through the opening between latching surfaces 36. The forward portion of connector 16 pushes against rear wall 30 to press latching mechanism 26 into port 24 and thus engage leveraging mechanism 32 to press sidewalls 28 towards each other. Clip 18 enters port 24 and latching mechanism 26 aligned with an opening so that clip 18 does not engage port 24 and thus does not interfere with the release of connector 16 on release of latching mechanism 26 from within port 24. Referring now to FIG. 5, a rear perspective view depicts a connector 16 completely inserted in port 24 and secured by latching mechanism 26. Leveraging mechanism 32 has closed resilient sidewalls 28 to a position proximate connector 16 so that latching surface 36 encloses the outer surface of connector 16. Push-push lock 38 locks latching mechanism 26 in place relative to port 24 so that pulling on cable 14 will not release connector 16. A subsequent push against connector 16 into rear wall 30 translates to push-push lock 38 to release lock 38. Biasing mechanism 34 pushes outward against rear wall 30 once lock 38 releases so that the resilient sidewalls 28 open as allowed by leveraging mechanism 32.

Figure 6:
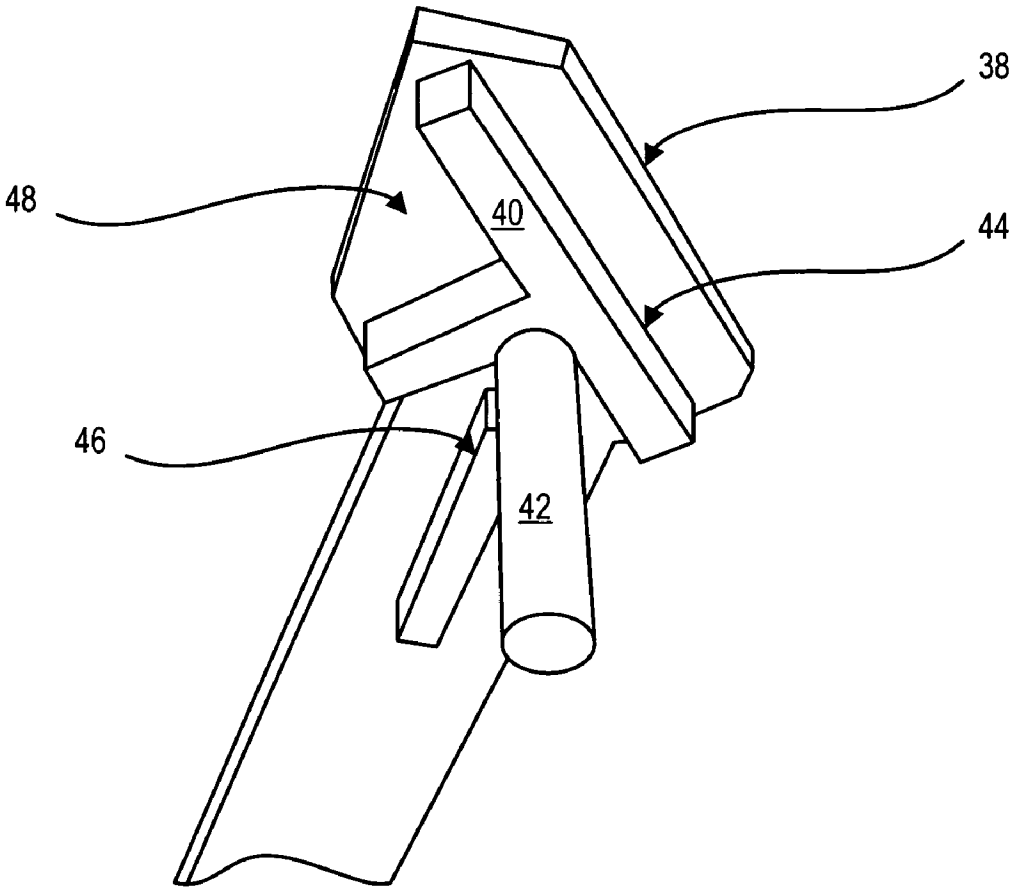
FIG. 6 depicts an exemplary embodiment of a push-push lock.

Referring now to FIG. 6, a bottom view of an exemplary push-push lock 38 is depicted. A locking surface 40 engages a locking post 42 to lock on a first push of locking surface 40 against locking post 42 and unlock on a second push locking surface 40 against post 42. The first push presses locking post 42 against diagonally-aligned surface 44 to guide locking post 42 into a locking opening 46. A subsequent push lifts locking post 42 out of locking opening 46 so that opposing diagonally-aligned surface 48 guides locking post 42 free from engagement to release push-push lock 38. Alternative embodiments of push-push lock 38 may be used as desired to meet design constraints, such as the amount of room available for lock 38 within information handling system 10.

Although the present invention has been described in detail, it should be understood that various changes, substitutions and alterations can be made hereto without departing from the spirit and scope of the invention as defined by the appended claims.

What is claimed is:

1. An information handling system comprising:

a housing;

processing components disposed in the housing and operable to process information;

plural networking ports disposed along the housing and interfaced with the processing components, each networking port operable to communicate information between the processing components and a cable connected to the port by a cable connector; and a push-push latch disposed in the housing proximate the each networking port and operable to secure the cable connector on a first push of the cable into the each networking port and to release the cable connector on a second push of the cable into the each networking port.

2. The information handling system of claim 1 wherein the cable connector has a clip operable to engage the port and wherein the push-push latch has an opening aligned with the clip to avoid engagement of the clip with the port.

3. The information handling system of claim 2 wherein the port is a Cat 5 port and the cable connector that interfaces with the Cat 5 port comprises an RJ45 connector.

4. The information handling system of claim 1 wherein the push-push latch comprises:

a latching mechanism having a rear wall adapted to interface the cable with the port, opposing elastic sidewalls coupled to the rear wall and a latching surface extending inwards from each sidewall, the latching surface aligned to engage the cable;

a biasing mechanism operable to bias the latching mechanism outward from the port;

a leveraging mechanism associated with the each sidewall and operable to close the latching surface to engage the cable as the latch mechanism pushes into the port; and a push-push lock coupled to the latching mechanism, the push-push lock operable to lock the latch in the port on a first push and release the latch from the port on a second push.

5. The information handling system of claim 4 wherein the cable has a clip operable to engage the port, and wherein the port and the latching mechanism having openings aligned with the clip to avoid engagement of the clip with the port.

6. The information handling system of claim 4 wherein the cable has a broken clip inoperable to engage the port, the push-push latching mechanism operable to secure the cable in the port.

7. The information handling system of claim 4 wherein the networking ports are local area network Ethernet ports.

8. The information handling system of claim 7 wherein the cables terminate with an RJ-45 connector.

9. A method for interfacing a network cable to an information handling system, the method comprising:

aligning a connector of the network cable with a port of the information handling system;

pushing the connector into the port a first time to secure the connector in the port and electrically interface the network cable with the information handling system, the network cable supporting communication of network information with the information handling system; and pushing the connector into the port a second time to release the connector from the port and electrically disconnect the network cable from the information handling system.

10. The method of claim 9 wherein the connector has a clip aligned to engage the port, the method further comprising:

avoiding the engagement of the clip with the port.

11. The method of claim 10 wherein the connector is an RJ-45 connector.

12. The method of claim 10 further comprising:

breaking the clip from the connector;

securing the connector to the port with the first push; and releasing the connector from the port with the second push.

13. The method of claim 9 wherein the information handling system comprises a server having plural networking ports, the method further comprising:

securing plural cables to the plural networking ports by pushing the cables into the ports the first push; and releasing selected of the plural cables by pushing the selected cables into the ports the second push.

14. The method of claim 13 wherein the cables are Cat 5 cables.

15. The method of claim 9 further comprising:

biasing the cable to withdraw from the port so that the cable automatically extends from the port upon the second push.

16. An information handling system networking cable push-push latch comprising:

a port having a front and rear, the port sized to accept a networking cable through the front and having wires at the rear to interface an information handling system with the networking cable;

a latching mechanism disposed in the port and operable to selectively secure or release the networking cable inserted through the port front; and a push-push lock interfaced with the latching mechanism and operable to secure the networking cable with the latching mechanism on a first push of the cable in the port and to release the networking cable from the latching mechanism on a second push of the cable in the port.

17. The information handling system networking cable push-push latch of claim 16 further comprising:

a biasing mechanism coupled to the port and the latching mechanism, the biasing mechanism operable to bias the latching mechanism to the front of the port;

wherein the latching mechanism moves to the front of the port to release the networking cable and moves to the rear of the port to secure the cable.

18. The information handling system networking cable push-push latch of claim 17 wherein the networking cable is a Cat 5 cable.

19. The information handling system networking cable push-push latch of claim 16 further comprising the cable having a connector, the connector having a clip operable to engage the port, wherein the port and latching mechanism have an opening aligned with the clip to avoid engagement of the clip to the port.

20. The information handling system networking cable push-push latch of claim 19 wherein the networking cable connector is a RJ-45 connector.

* * * * *